US010847299B2

(12) United States Patent
Mao et al.

(10) Patent No.: US 10,847,299 B2
(45) Date of Patent: Nov. 24, 2020

(54) MAGNETIC STRUCTURES WITH SELF-ENCLOSED MAGNETIC PATHS

(71) Applicant: Quanten Technologies Limited, Road Town (VG)

(72) Inventors: Hengchun Mao, Allen, TX (US); Bo Yang, Allen, TX (US)

(73) Assignee: Quanten Technologies Limited, Road Town (VG)

( * ) Notice: Subject to any disclaimer, the term of this patent is extended or adjusted under 35 U.S.C. 154(b) by 123 days.

(21) Appl. No.: 15/334,760

(22) Filed: Oct. 26, 2016

(65) Prior Publication Data

US 2017/0117085 A1 Apr. 27, 2017

Related U.S. Application Data

(60) Provisional application No. 62/246,411, filed on Oct. 26, 2015.

(51) Int. Cl.

| | |
|---|---|
| ***H01F 17/00*** | (2006.01) |
| ***H01F 5/00*** | (2006.01) |
| ***H01F 27/28*** | (2006.01) |
| ***H01F 27/40*** | (2006.01) |
| ***H01F 38/14*** | (2006.01) |
| ***H01F 41/02*** | (2006.01) |

(52) U.S. Cl.

CPC ..... *H01F 27/2804* (2013.01); *H01F 27/40* (2013.01); *H01F 38/14* (2013.01); *H01F 41/02* (2013.01)

(58) Field of Classification Search

CPC ..... H01F 38/14; H01F 2027/2819; H01F 27/2804; H01F 41/041; H01L 23/5227; H01L 23/645

USPC ..... 336/105, 200

See application file for complete search history.

(56) References Cited

U.S. PATENT DOCUMENTS

| | | | | | |
|---|---|---|---|---|---|
| 2,659,819 | A * | 11/1953 | Clough | G01S 1/02 | 343/743 |
| 3,842,186 | A * | 10/1974 | Hall | H01F 27/324 | 174/396 |
| 5,061,910 | A * | 10/1991 | Bouny | H01F 27/2804 | 333/26 |
| 5,345,222 | A * | 9/1994 | Davies | G08B 13/2408 | 340/551 |
| 5,477,204 | A * | 12/1995 | Li | H01F 17/0006 | 336/200 |
| 6,894,598 | B2 * | 5/2005 | Heima | H01F 17/0013 | 257/E27.046 |
| 7,002,434 | B2 * | 2/2006 | Lin | H03H 7/09 | 333/167 |
| 7,057,488 | B2 * | 6/2006 | Van Haaren | H01L 27/08 | 257/E21.022 |
| 7,072,636 | B2 * | 7/2006 | Dobrovolny | H03D 7/1408 | 455/313 |

(Continued)

*Primary Examiner* — Alexander Talpalatski
*Assistant Examiner* — Joselito S Baisa
(74) *Attorney, Agent, or Firm* — Slater Matsil, LLP

(57) ABSTRACT

A structure comprises a first portion of a winding having a first almost enclosed shape, a second portion of the winding having a second almost enclosed shape and a connection element between the first portion and the second portion, wherein the first portion and the second portion are arranged in a symmetrical manner and the first portion, the second portion and the connection element form a first air core inductor.

8 Claims, 15 Drawing Sheets

(56) References Cited

U.S. PATENT DOCUMENTS 7,221,251 B2 5/2007 Menegoli et al.
7,253,711 B2 8/2007 Pleskach et al.
7,302,249 B1 * 11/2007 Fudem ..... H01P 5/10 333/26
7,446,632 B2 * 11/2008 Tomonari ..... H01F 17/0013 333/185
7,839,253 B2 * 11/2010 Lu ..... H01F 17/0006 336/200
8,049,588 B2 * 11/2011 Shibuya ..... H01F 17/04 336/83
8,058,850 B2 * 11/2011 Ganev ..... H02P 9/006 322/25
8,203,335 B2 6/2012 Feldtkeller
8,284,010 B2 * 10/2012 Tsuji ..... H01F 17/0006 336/192
8,552,821 B2 * 10/2013 Nagai ..... H01P 1/2013 310/320
8,576,039 B2 * 11/2013 Yoon ..... H01L 23/5227 336/192
9,165,706 B2 * 10/2015 Ishida ..... H01F 17/0013
9,466,421 B2 * 10/2016 Kawai ..... H01F 38/14
2005/0140486 A1 * 6/2005 Lin ..... H01F 17/0013 336/200
2008/0122569 A1 * 5/2008 Ye ..... H01F 27/2852 336/223
2008/0158848 A1 * 7/2008 Free ..... G06F 3/046 361/818
2008/0246579 A1 * 10/2008 Mizuno ..... H01F 17/0013 336/205
2009/0174515 A1 * 7/2009 Lee ..... H01F 27/2804 336/182
2010/0253464 A1 * 10/2010 Miyoshi ..... H01F 17/0013 336/200
2012/0112979 A1 * 5/2012 Kato ..... H01P 1/20 343/853
2013/0214888 A1 * 8/2013 Nogi ..... H01F 17/0013 336/192
2013/0257577 A1 * 10/2013 Nazarian ..... H01F 5/003 336/200
2013/0321116 A1 * 12/2013 Tiemeijer ..... H01F 27/29 336/200
2014/0306553 A1 * 10/2014 Lee ..... G06F 1/3234 307/326
2015/0207334 A1 7/2015 Mitcheson et al.
2015/0340754 A1 * 11/2015 Asou ..... H01Q 1/2225 343/788

* cited by examiner

MAGNETIC STRUCTURES WITH SELF-ENCLOSED MAGNETIC PATHS

CROSS REFERENCE TO RELATED APPLICATIONS

This application is related to, and claims priority to, U.S. Provisional Application No. 62/246,411, titled "Magnetic Structures with Self-Enclosed Magnetic Paths," filed on Oct. 26, 2015, which is herein incorporated by reference.

TECHNICAL FIELD

The present invention relates to a winding structure, and, in particular embodiments, to a winding structure in a wireless power transfer system.

BACKGROUND

Many power inductors, including those used in power converters and EMI filters, and transmitter coils and receiver coils in wireless power transfer (WPT) systems, are required to operate at high frequencies in a range from 1 MHz to few hundreds of MHz. To achieve better efficiency, the windings of such inductors are required to be carefully designed. Since magnetic materials' performance at such a higher frequency is not good, air core inductors may have to be used. As a result, the corresponding inductance of an air core inductor is usually small.

Traditional air core inductors usually are bulky and have high power losses. Furthermore, the traditional air core inductors may cause significant magnetic interference to nearby components. More particularly, by employing the traditional air core inductors, the interaction between the air core inductors and surrounding components can cause significant problems such as magnetic interference disturbing the operation of the surrounding components and increasing power losses caused by induced eddy currents in adjacent metal parts or traces and/or the like.

FIG. 1 illustrates a variety of implementations of traditional air core inductors or coils. (A) of FIG. 1 shows an air core inductor on a printed circuit board (PCB) comprises one turn. This turn can be implemented as either a wire or a PCB trace. It is well known that a magnetic field can be established after having a current flow through the one turn of the air core inductor.

(B) and (C) of FIG. 1 show air core inductors having more than one turn. The turns of the air core inductors are formed by wires or PCB traces. As shown in (B) of FIG. 1 and (C) of FIG. 1, each turn is a circular or spiral winding formed in one or more layers of the PCB. The circular or spiral windings may be implemented as metal traces or metal tracks. Furthermore, vias or other suitable interconnect elements can be used to connect the metal traces formed in different layers of the PCB if necessary.

The inductor structures shown in FIG. 1 can provide desired inductance. However, a significant portion of the magnetic field generated by the inductor structures may expand out of the winding area. FIG. 2 illustrates the magnetic flux distribution of an inductor structure shown in FIG. 1. As shown in FIG. 2, a significant portion of the magnetic flux is located in the surrounding region of the air core inductor shown in (A) of FIG. 1, especially in the space either above or below the coil. Since the winding structure shown in FIG. 1 is not self-enclosed, the magnetic flux generated from this inductor will be outside this inductor. This magnetic field outside the inductor will cause magnetic interference to the metal or other components nearby, thereby generating unnecessary power losses.

It is therefore important to have an inductor or coil structure to reduce the impact of air core magnetic components on the surrounding components (e.g., metal components), especially in the space either above or below the coil. Such a reduced impact from the air core inductor structure could also be applied to transmitter and receiver windings in a wireless power transfer system, where the magnetic field should be contained as much as possible in the charging area.

SUMMARY OF THE INVENTION

These and other problems are generally solved or circumvented, and technical advantages are generally achieved, by preferred embodiments of the present invention which provide a winding structure having better magnetic coupling.

In accordance with an embodiment, a structure comprises a first portion of a winding having a first almost enclosed shape and a second portion of the winding having a second almost enclosed shape, wherein the first portion and the second portion are configured to flow a current from the first portion to the second portion, and wherein a first magnetic flux through the first portion and a second magnetic flux through the second portion are vertically opposite to each other and the first portion and the second portion form a first air core inductor, and wherein the first portion and the second portion are arranged to enhance a magnetic field strength at a center portion of the first air core inductor.

In accordance with another embodiment, a system comprises a transmitter coil having a first winding structure, a receiver coil having a similar winding structure as the transmitter coil, wherein the receiver coil is configured to be magnetically coupled to the transmitter coil and a metal plate with an opening placed between the transmitter coil and the receiver coil.

In accordance with yet another embodiment, a method comprises wirelessly transferring power from a transmitter coil to a receiver coil, wherein at least one of the transmitter coil and the receiver coil comprises a first portion having a first almost enclosed shape wound in a clockwise direction, a second portion having a second almost enclosed shape wound in a counter-clockwise direction and a connection portion between the first portion and the second portion, wherein the first portion and the second portion are arranged in a substantially symmetrical manner.

An advantage of a preferred embodiment of the present invention is improving a wireless power transfer system's performance through a winding structure having better magnetic flux and flux distribution in comparison with a conventional winding structure.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

Corresponding numerals and symbols in the different figures generally refer to corresponding parts unless otherwise indicated. The figures are drawn to clearly illustrate the relevant aspects of the various embodiments and are not necessarily drawn to scale.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to preferred embodiments in a specific context, namely a winding structure applied in a wireless power transfer system. The winding structure can improve the performance of air core inductors. The winding structure described in this disclosure can be implemented in a variety of suitable materials and structures. For example, the winding structure may be integrated into a substrate such as a printed circuit board (PCB). The invention may also be applied, however, to a variety of power systems. Hereinafter, various embodiments will be explained in detail with reference to the accompanying drawings.

Figure 3:
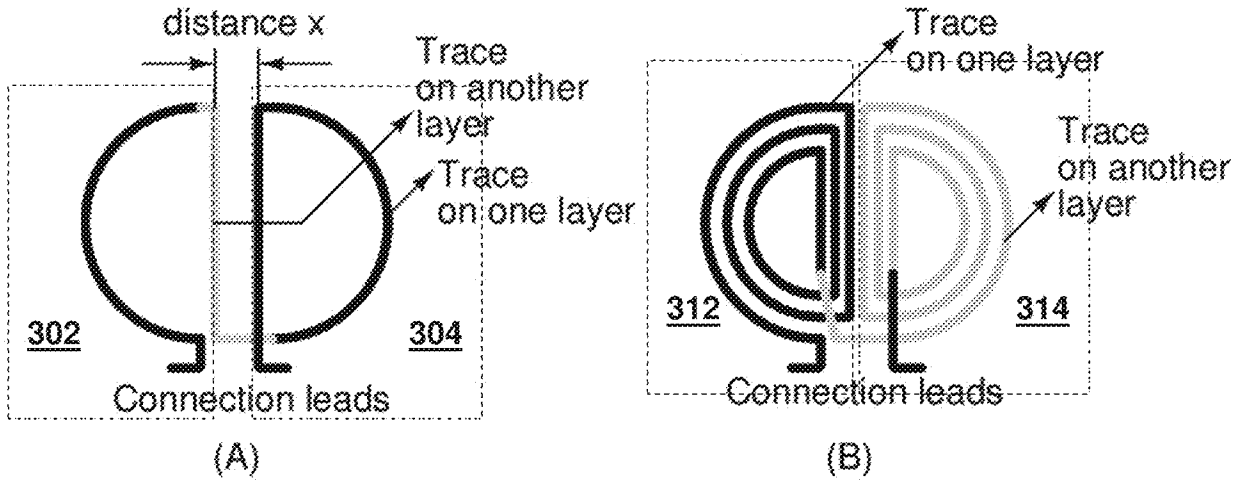
FIG. 3 illustrates two different implementations of an inductor structure having self-enclosed magnetic paths in accordance with various embodiments of the present disclosure.

FIG. 3 illustrates two different implementations of an inductor structure having self-enclosed magnetic paths in accordance with various embodiments of the present disclosure. The inductor structures shown in FIG. 3 are employed to reduce the flux expansion of air core inductors. (A) of FIG. 3 shows a single-turn configuration of an inductor structure having self-enclosed magnetic paths. (B) of FIG. 3 shows a multi-turn configuration of an inductor structure having self-enclosed magnetic paths.

As shown in (A) of FIG. 3, a spiral winding is divided into two portions, namely a first portion 302 and a second portion 304. Each portion comprises a straight line and an arc. The straight line of the first portion and the straight line of the second portion are placed adjacent to each other, thereby enhancing the magnetic flux distribution of the spiral winding. This feature will be discussed in detail with respect to FIG. 4. The arc of each portion connects the two terminals of the straight line with a relatively short length for a given area. Such a relatively short length helps to reduce the resistance of the spiral winding.

As shown in (A) of FIG. 3, the first portion 302 and the second portion 304 may be slightly separated from each other. The separation between these two portions is defined as X as shown in (A) of FIG. 3. In some embodiments, X is slightly greater than zero. X may be adjusted based upon design needs to improve a parameter of the structure shown in (A) of FIG. 3. For example, the inductance, resistance and inductance-to-resistance ratio of the structure shown in (A) of FIG. 3 may be improved by adjusting the value of X. Furthermore, in order to increase the inductance of the winding, more traces may be employed to form a multi-turn structure as shown in (B) of FIG. 3. In addition, traces formed on different layers (not shown) may be connected in parallel to reduce the resistance of the winding without significantly affecting the inductance of the winding.

A first portion 302 of the winding forms a first half circle. Likewise, a second portion 304 forms a second half circle. When a current flows through the winding, each portion of the winding will generate a magnetic flux. The direction of the magnetic flux in the first half circle is opposite to the direction of the magnetic flux in the second half circle with reference to the vertical axis which is perpendicular to the winding. The magnetic fluxes in opposite directions form a self-enclosed magnetic path. Such a self-enclosed magnetic path helps to enhance the magnetic field within these two portions and reduce the magnetic flux outside the inductor structure through an appropriate arrangement of the winding in these two portions as shown in (A) of FIG. 3.

In some embodiments, the windings are so arranged such that the direction of the magnetic flux inside the first portion 302 is opposite to the direction of the magnetic flux inside the second portion 304 of the winding. In other words, the magnetic fluxes coupled to both the first portion and the second portion can form a closed loop within the space immediately adjacent to the inductor structure, and the current in each portion of the winding strengthens this coupled flux. In contrast, to a point outside this space, the magnetic flux there has been weakened because the magnetic flux from the first portion 302 and the magnetic flux from the second portion 304 tend to cancel each other out.

(A) of FIG. 3 shows the inductor structure may be formed in at least two different layers of a PCB. For example, the traces in black may be formed in a first layer of the PCB; the traces in gray may be formed in a second layer of the PCB. The first layer may be immediately next to the second layer in the PCB. Alternatively, the first layer and the second layer may be separated by a plurality of PCB layers. In some embodiments, the traces in the first layer are connected to the traces in the second layer through suitable interconnect structures such as vias and the like.

(B) of FIG. 3 shows an inductor structure similar to that shown in (A) of FIG. 3 except that each portion has multiple turns. A first portion 312 includes a trace or a coil wound in a clockwise direction. A second portion 314 includes a trace or a coil wound in a counter-clockwise direction. After a current flows through the inductor structure shown in (B) of FIG. 3, magnetic fields are established in the first portion 312 and the second portion 314 respectively. More particularly, the magnetic field generated in the first portion 312 and the magnetic field generated in the second portion 314 are in opposite directions with reference to the vertical axis. To a point outside the space immediately adjacent to the inductor structure shown in (B) of FIG. 3, these two magnetic fields may cancel each other out or at least portions of the magnetic fields may cancel each other out.

(B) of FIG. 3 shows the inductor structure may be formed in at least two different layers of a PCB. For example, the traces in black may be formed in a first layer of the PCB; the traces in gray may be formed in a second layer of the PCB. The first layer may be immediately next to the second layer in the PCB. Alternatively, the first layer and the second layer may be separated by a variety of PCB layers. In some embodiments, the traces in the first layer are connected to the traces in the second layer through suitable interconnect structures such as vias and the like.

Figure 4A:
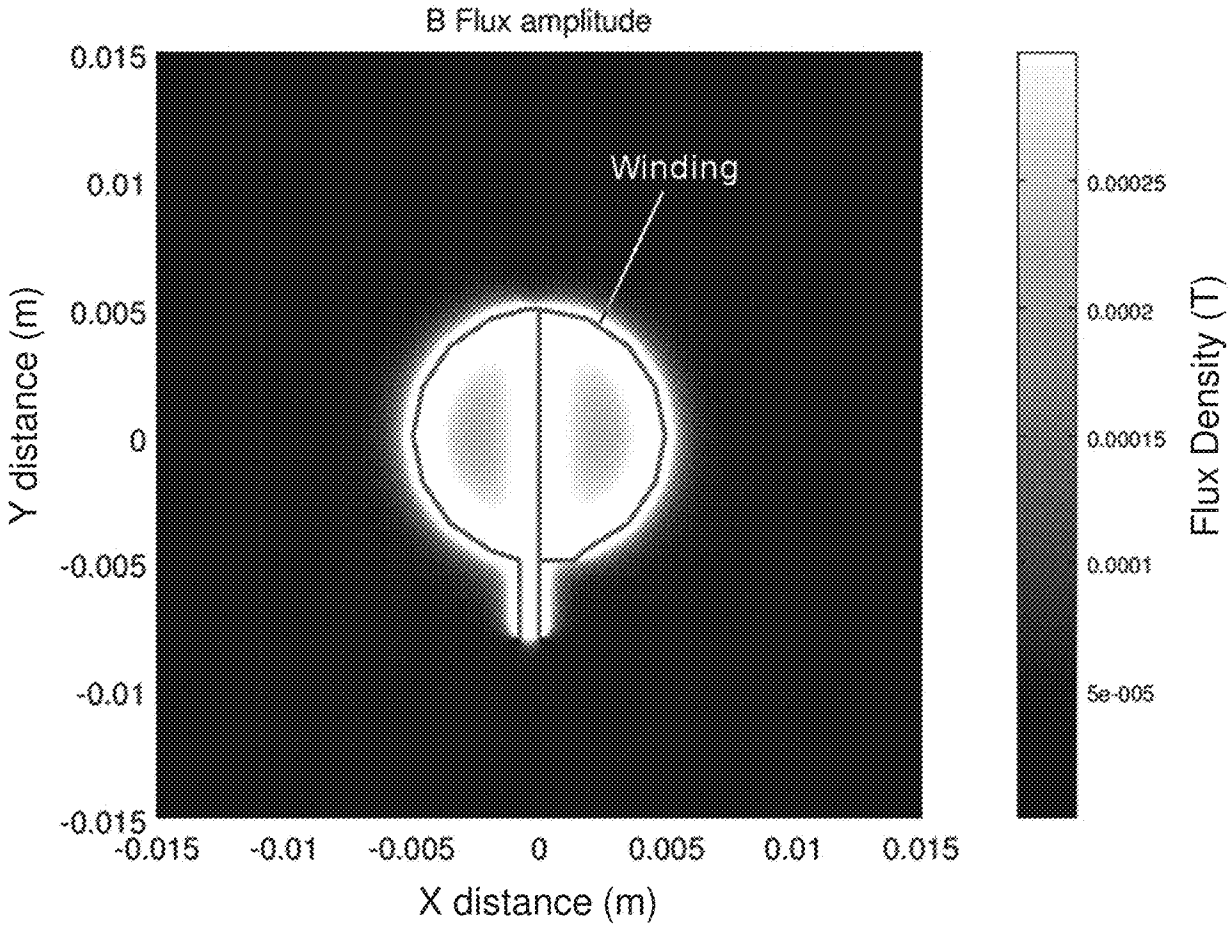
FIG. 4A illustrates the X-Y plane magnetic flux distribution of the inductor structure shown in (A) of FIG. 3 in accordance with various embodiments of the present disclosure.

FIG. 4A illustrates the magnetic flux distribution of the inductor structure shown in (A) of FIG. 3 in accordance with various embodiments of the present disclosure. The magnetic flux distribution of the inductor structure shown in FIG. 4A is established after a current flows through the inductor structure shown in (A) of FIG. 3. By employing the structure shown in (A) of FIG. 3, the magnetic field outside the winding is constrained inside a much smaller area surrounding the winding (a.k.a. coil). Especially, the structure shown in (A) of FIG. 3 helps to improve the magnetic flux distribution in the X-Z plane.

Figure 1:
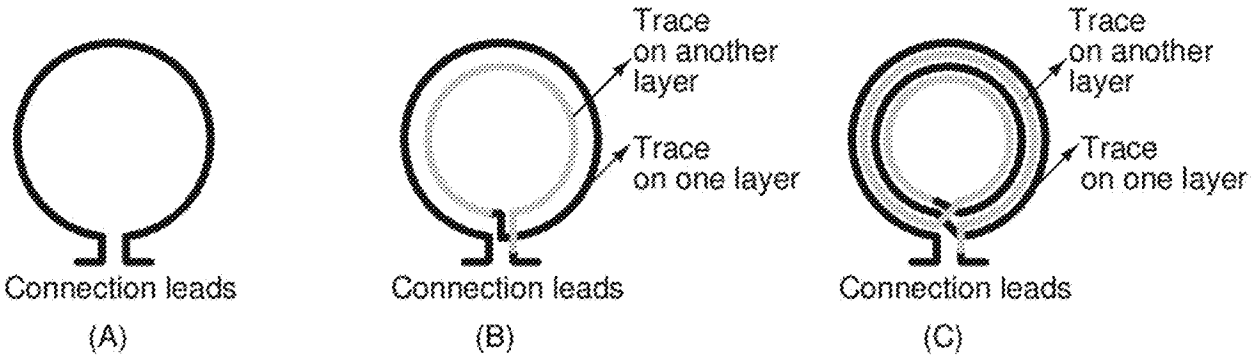
FIG. 1 illustrates a variety of implementations of traditional air core inductors.
Figure 4B:
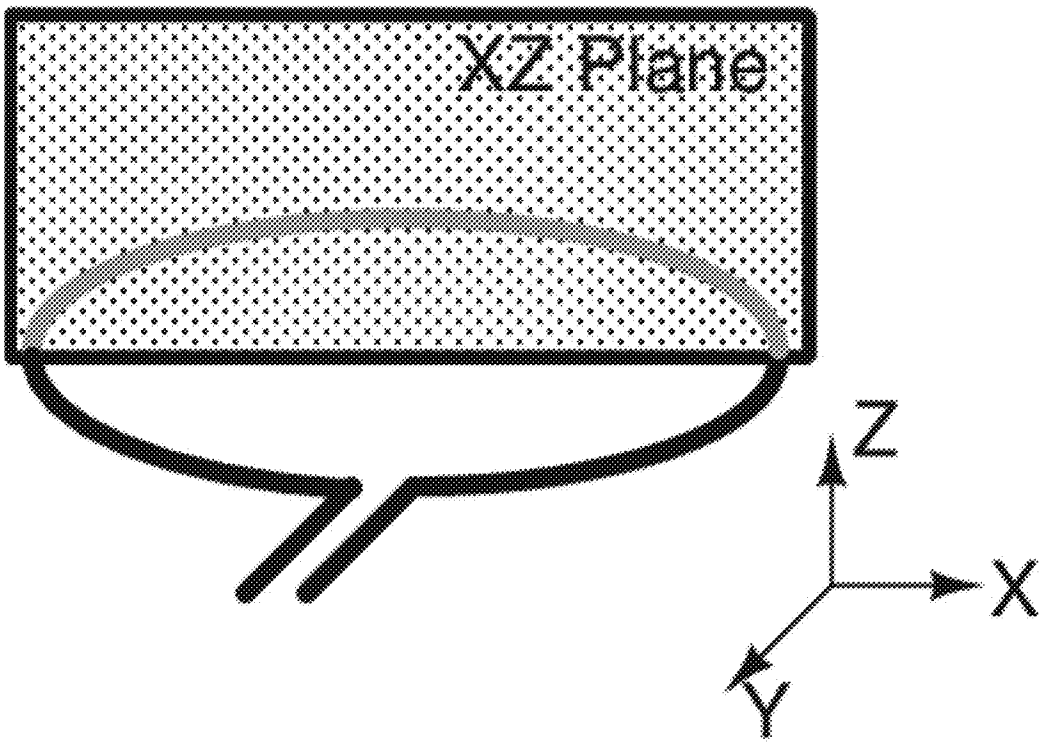
FIG. 4B illustrates the X-Z plane of the inductor structure.
Figure 4C:
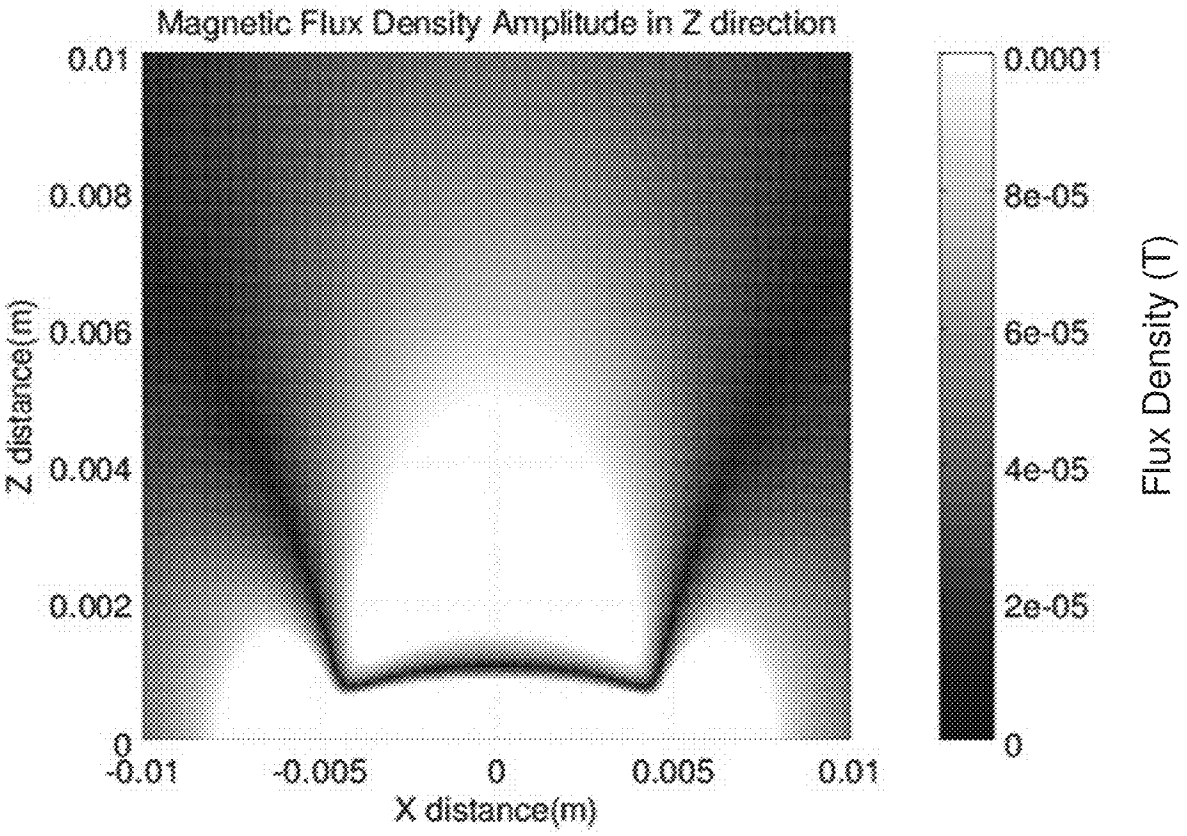
FIG. 4C illustrates the X-Z plane magnetic flux distribution of the inductor structure shown in (A) of FIG. 1 in accordance with various embodiments of the present disclosure.
Figure 4D:
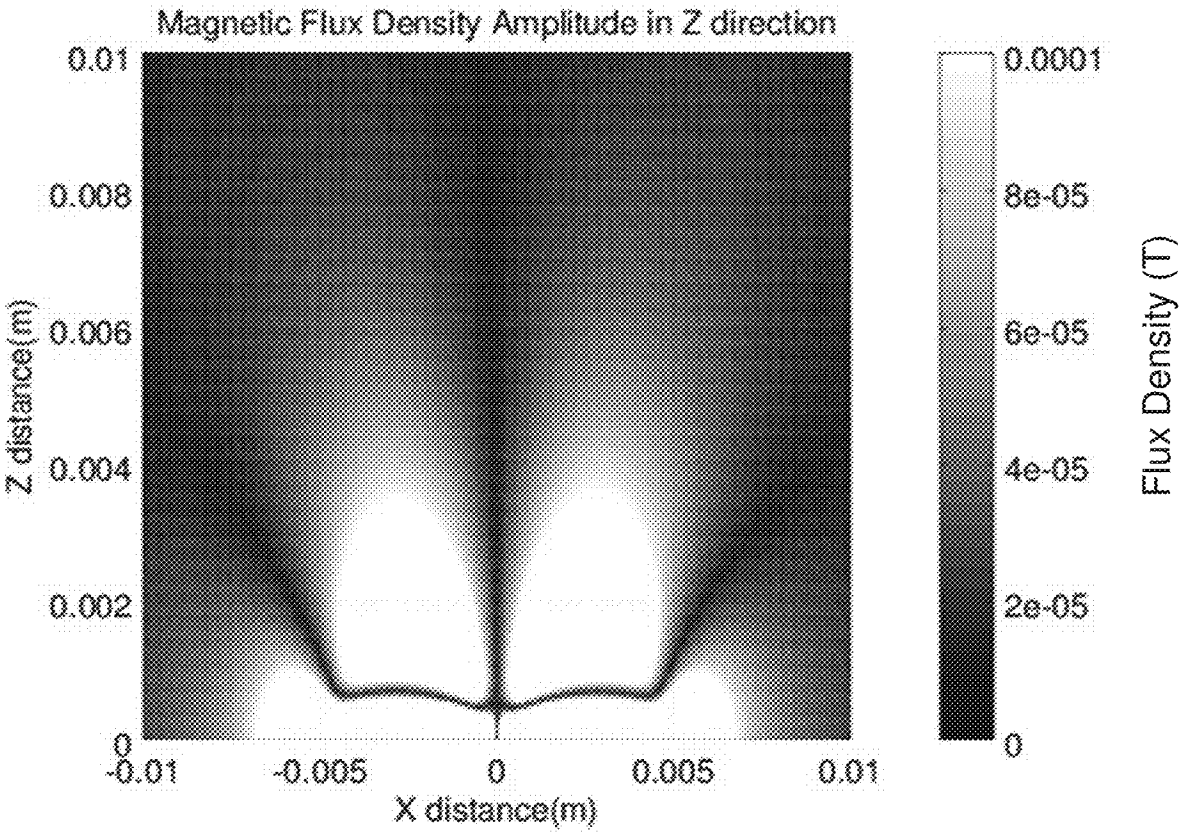
FIG. 4D illustrates the X-Z plane magnetic flux distribution of the inductor structure shown in (A) of FIG. 3 in accordance with various embodiments of the present disclosure.

FIG. 4B illustrates the X-Z plane of the inductor structure. In some embodiments, the inductor structure is on an X-Y plane. The Z axis is orthogonal to the X-Y plane as shown in FIG. 4B. FIG. 4C illustrates the X-Z plane magnetic flux distribution of the inductor structure shown in (A) of FIG. 1 in accordance with various embodiments of the present disclosure. FIG. 4D illustrates the X-Z plane magnetic flux distribution of the inductor structure shown in (A) of FIG. 3 in accordance with various embodiments of the present disclosure. By employing the inductor structure shown in (A) of FIG. 3, the magnetic flux density over the inductor structure (in the Z direction) shown in FIG. 4D is much smaller than that shown in (C) of FIG. 3.

Figure 2:
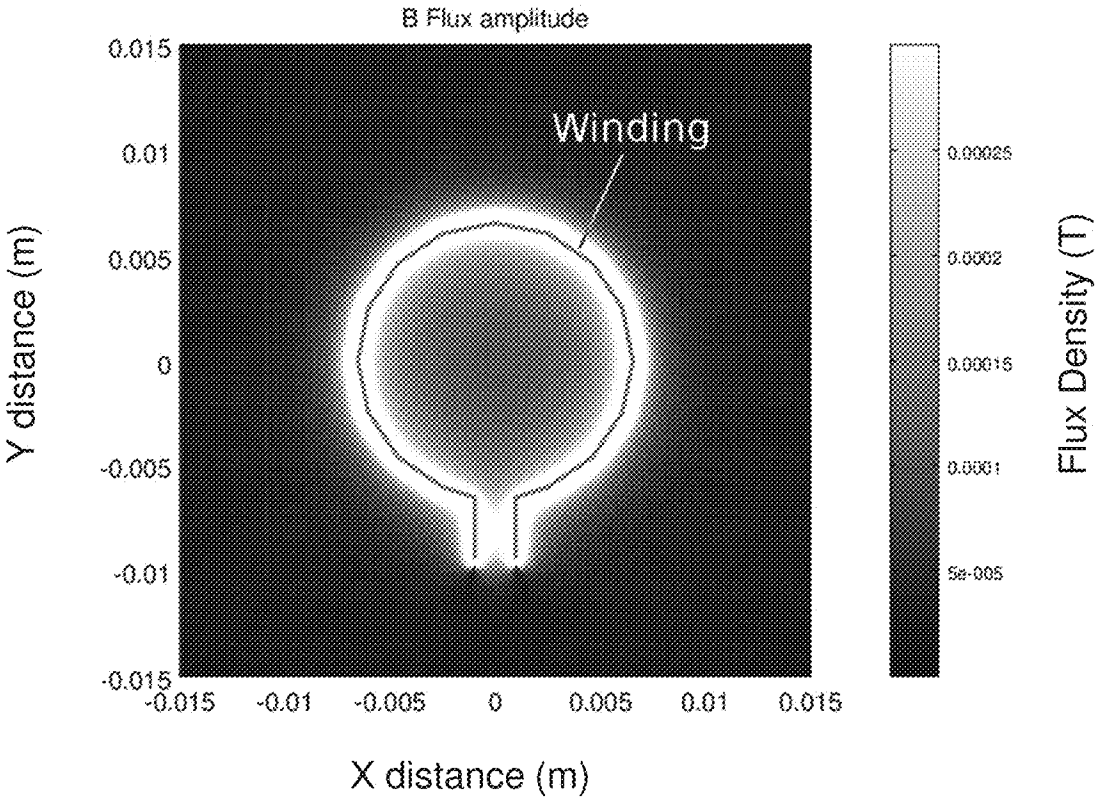
FIG. 2 illustrates the magnetic flux distribution of an inductor structure shown in (A) of FIG. 1.

In addition, the flux density within the coil, as shown in FIG. 4A, is much stronger than that shown in FIG. 2 in many areas. Especially, since the two straight lines in the center of the inductor structure carry currents in the same direction, the magnetic flux density around the center of the inductor structure has been significantly enhanced. In other words, compared to the conventional structure shown in FIG. 1, the structures shown in FIG. 3 has more magnetic energy inside the adjacent space, thereby achieving higher inductance and reducing magnetic interference outside this adjacent space. In FIGS. 4A, 4C and 4D, the brightness of color represents the strength of magnetic field as well as the magnetic flux density amplitude.

By employing the inductor structures shown in FIG. 3, other metal traces or components could be placed adjacent to the air core magnetic component without having issues such as interference, eddy current induced losses and the like. For example, a near field communication (NFC) coil may be placed adjacent to the inductor structure without the risk of being damaged.

It should be noted that the shape of the winding does not have to be a circular or spiral shape. Different portions of the winding may have different shapes. For example, the arc may be replaced by a series of straight lines, or one or more small arcs connected by straight lines. The straight line shown in FIG. 3 may be replaced by one or more arcs or a combination of straight lines and arcs. As long as it is a closed shape, the two portions of the winding are more or less symmetrical with respect to the center, and the lines around the center carry currents in roughly the same direction, the concept described above works. Also, the shape does not have to be divided into two portions. It can be divided into more than two portions if necessary. This structure could be used for a variety of applications such as windings of air core inductors and transmitter/or receiver coils having a constrained magnetic field. Furthermore, a magnetic material such as a magnetic plate or film serving as a magnetic shield may be placed on one side of the coil or the PCB where the coil structure is formed.

Furthermore, in certain applications such as wireless power transfer systems, a strong external magnetic field may be present around a magnetic component of a wireless power transfer system such as an inductor in an EMI filter or an impedance matching circuit. The external magnetic flux may be coupled with the magnetic component of the wireless power transformer system and affect its operation. This impact is more detrimental if the magnetic component is an air core inductor. It is therefore desirable to design an air core inductor less susceptible to a magnetic field generated by other components placed adjacent to the air core inductor. Applying this winding structure to wireless power transfer systems will be discussed in detail with respect to FIGS. 6-12.

Figure 5:
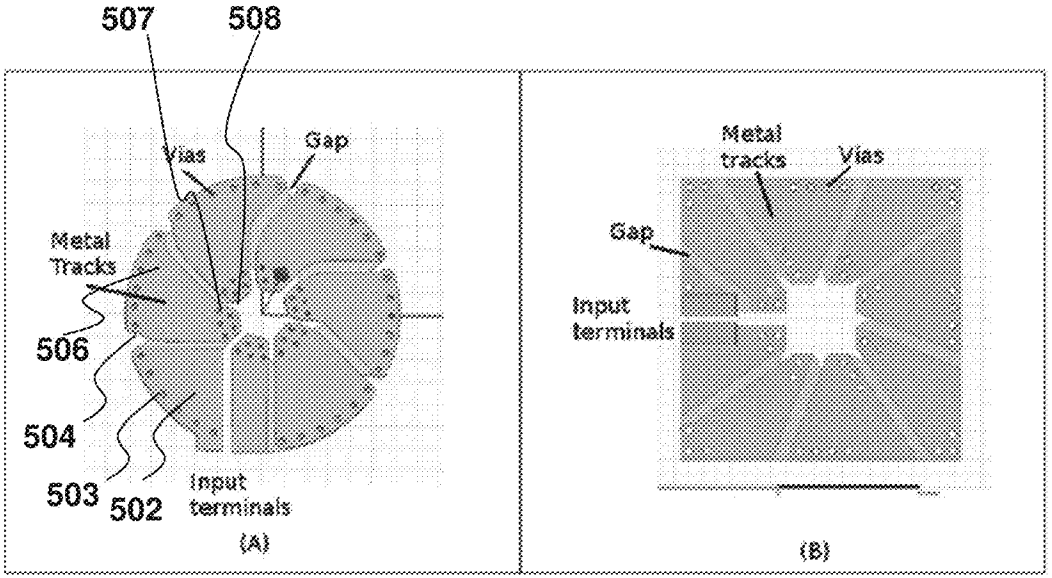
FIG. 5 illustrates implementations of inductor structures having self-enclosed magnetic paths in accordance with various embodiments of the present disclosure.

FIG. 5 illustrates implementations of inductor structures having self-enclosed magnetic paths in accordance with various embodiments of the present disclosure. (A) of FIG. 5 shows an inductor structure, which is circular in shape. (B) in FIG. 5 shows an inductor structure, which is square in shape.

The configuration and operation principle of the structure shown in (B) of FIG. 5 is similar to that of the structure shown in (A) of FIG. 5. For simplicity, only the configuration and operation principle of the structure shown in (A) of FIG. 5 is discussed in detail herein to avoid unnecessary repetition.

(A) of FIG. 5 shows a circular-shaped metal trace with certain width on one layer of a PCB. As shown in (A) of FIG.

5, this circular-shaped metal trace is divided into several pieces, with each piece being part of a single-turn winding section. The pieces shown in (A) of FIG. 5 may be alternatively referred to as metal tracks.

The pieces on a first layer of the PCB collectively form part of a winding. Similarly, metal tracks on a second layer (not shown) of the PCB formed by a similar circular-shaped metal trace form another part of the winding. In some embodiments, the metal tracks on these two layers are vertically aligned to each other. If needed, metal tracks on different layers can be connected in parallel to reduce the resistance of the structure.

Vias or other means (such as edge plating) can be used to connect the two parts of the winding to form a complete winding, which may have one or multiple turns. In this way, the space formed by the metal tracks on two different layers and the connecting vias has a toroidal shape. As a result, a strong magnetic field can be generated within the toroidal shape when a current flows through the winding.

As shown in (A) of FIG. 5, there may be a plurality of gaps formed on the first layer of the PCB. A gap (e.g., gap 504) separates the adjacent metal tracks (e.g., metal tracks 502 and 506) of the winding. When a current flows in the metal track 502 of the first layer of the PCB, it has to flow into the metal track underneath the metal track 502 through the vias 503 because there is a gap 504 between the metal track 502 and its adjacent metal track 506. Similarly, the current cannot get into the adjacent metal track in the second layer because of the gap 508. The current has to flow into the metal track 506 through the vias 507. As a result, the current flow path has a toroidal shape.

An air core magnetic structure based upon the toroidal shape shown in (A) of FIG. 5 has an enclosed magnetic flux path in the toroidal space between the different layers of a multi-layer PCB. The structures shown in (A) of FIG. 5 have various advantages. First, this enclosed magnetic flux path reduces the impact of the magnetic field generated by this inductor to other components or PCB traces. Second, it also reduces the coupling between an external magnetic field and this inductor.

In should be noted the shapes of the metal tracks as well as the winding shown in FIG. 5 are merely examples. A person skilled in the art would understand other shapes can also be used as long as they are in a closed geometric shape and the magnetic field generated by the winding structure is closed accordingly.

It should be noted that this structure shown in FIG. 5 still generates some magnetic flux outside the toroidal space. To a point outside the toroidal space, the winding forms a one-turn inductor, which is similar to the one shown in (A) of FIG. 1. This one-turn-inductor can cause some disturbance to nearby components, and also increase susceptibility to the external magnetic field.

To reduce this effect, the shape of the inductor (which is a circular shape in (A) of FIG. 5 and a square shape in (B) of FIG. 5 may be divided into two or more parts which form a more complex shape such as that shown in (A) of FIG. 3 and (B) of FIG. 3. As a result, an enclosed magnetic path can be formed along the shape. Again, other shapes can also be used as long as it is geometrically enclosed and the parts are more or less symmetrical.

For high end mobile devices, metal back covers have been used for its beauty, durability and strength. A magnetic field cannot penetrate the metal back cover easily, and the magnetic coupling between a winding inside the mobile device and a winding outside the mobile device is too weak to transfer significant power or signals when a metal back cover is present. This is a challenge for designing high performance wireless power transfer systems or other wireless signal transfer systems. One way to get around this problem is to cut an opening on the metal back cover.

With a traditional transmitter winding, most magnetic flux in the opening is in the same direction, and the magnetic flux passing through the opening will induce significant eddy currents in the metal components around the opening, thereby causing high power losses in the metal components and generating a magnetic field against the magnetic flux from the transmitter. Because of this, even with opening, the magnetic flux still cannot pass through the metal back cover easily, and the magnetic coupling between windings inside and outside the device is still very weak.

By employing the self-closed winding structures shown in (A) of FIG. 3 and (B) of FIG. 3, this problem could be solved. With the self-closed winding structure, within a charging area, the magnetic fluxes will have different directions around the two portions described above with respect to FIG. 3. In some embodiments, the sum of the total magnetic flux in the two portions should be zero or very small. Therefore, the total magnetic flux passing through the hole is also small, and it may not induce any significant currents in the metal components placed adjacent to the self-closed winding structures. As a result, with an opening in the metal back cover, the magnetic flux could easily pass through the opening, and a good magnetic coupling can be established between a coil inside the device and a coil outside the device. Moreover, the opening can be shaped and sized in such a way that the metal loop around the opening has proper impedance, so the eddy current in this loop can enhance the magnetic coupling. The advantage of applying the inductor structure shown in FIG. 3 to a wireless power transfer system will be discussed below in detail with respect to FIGS. 6-12.

Figure 6:
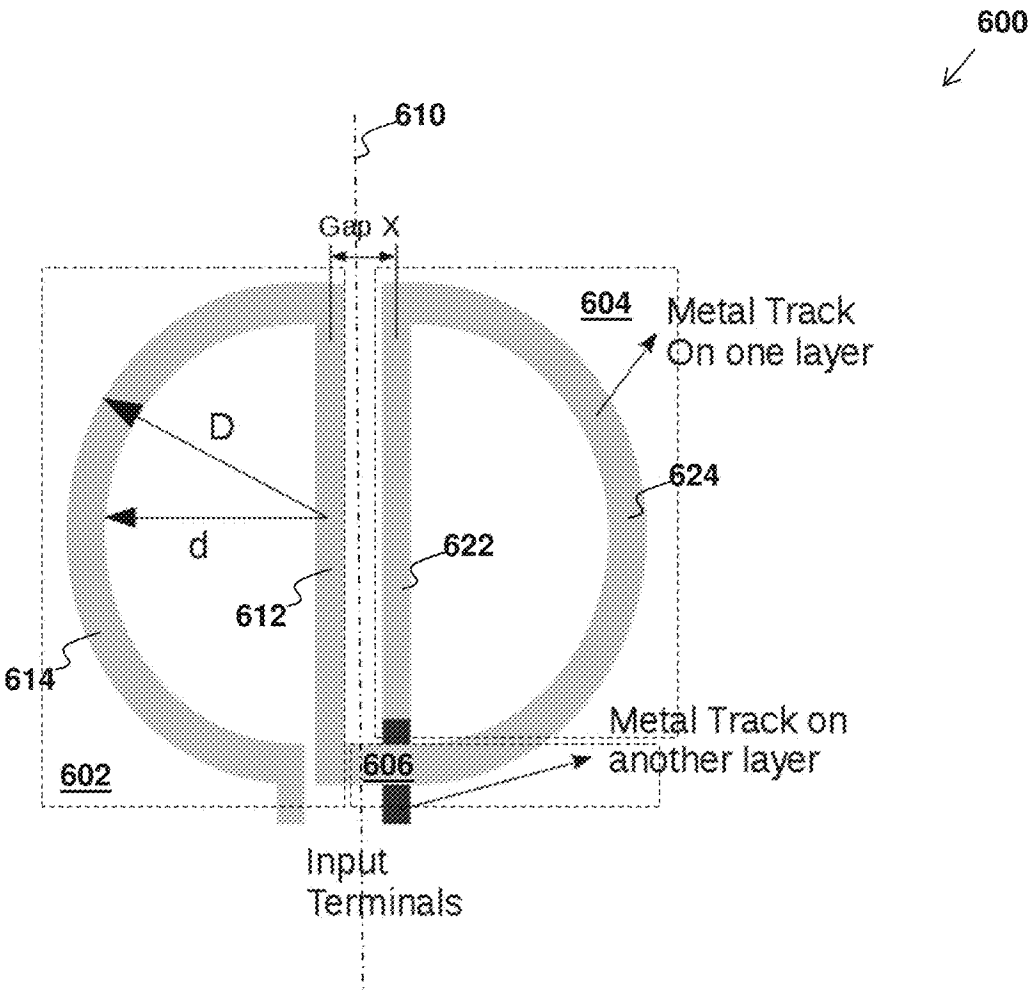
FIG. 6 illustrates a winding structure in a wireless power transfer system in accordance with various embodiments of the present disclosure.

FIG. 6 illustrates a winding structure in a wireless power transfer system in accordance with various embodiments of the present disclosure. In some embodiments, the winding structure 600 shown in FIG. 6 can be used as a transmitter winding structure. In alternative embodiments, the winding structure 600 shown in FIG. 6 can be used as a receiver winding structure. Throughout the description, the winding structure 600 shown in FIG. 6 may be alternatively referred to as a transmitter coil or a receiver coil depending on different applications.

The winding structure 600 can be divided into three portions. A first portion 602 of the winding structure 600 has a first almost enclosed shape. A second portion 604 of the winding structure 600 has a second almost enclosed shape. A third portion 606 functions as a connection element placed between the first portion 602 and the second portion 604. As shown in FIG. 6, the first portion 602 and the second portion 604 are arranged in a substantially symmetrical manner. In some embodiments, an air core inductor may be formed by the first portion 602, the second portion 604 and the third portion 606.

As shown in FIG. 6, the first portion 602 comprises a first straight line 612 and a first non-straight line 614. The second portion 604 comprises a second straight line 622 and a second non-straight line 624. The first straight line 612 is immediately next to and in parallel with the second straight line 622. Furthermore, the first non-straight line 614 and the second non-straight line 624 are on opposite sides of a center line 610 between the first straight line 612 and the second straight line 622. Throughout the description, the first non-straight line 614 and the second non-straight line 624 are alternatively referred to as the first curved line and the second curved line respectively. The third portion 606 may be alternatively referred to as the connection element 606.

As shown in FIG. 6, the third portion 606 intersects a portion (in black) of the second straight line 622. In some embodiments, the winding structure 600 is formed in a PCB having a plurality of layers. The third portion 606 may be formed in a first layer of the PCB. The portion of the second straight line 622 is in a second layer of the PCB. The first layer and the second layer are stacked on top of each other. As shown in FIG. 6, the first portion 602, the third portion 606, the second non-straight line 624 of the second portion 604 and an upper portion (in gray) of the second straight line 622 are formed in the first layer. The lower portion (in black) of the second straight line 622 intersects the third portion 606. The lower portion of the second straight line 622 is formed in the second layer. There may be an interconnect element (e.g., via) connected between the lower portion of the second straight line 622 and the upper portion of the second straight line 622.

It should be noted that forming a winding structure in the PCB shown in FIG. 6 is merely an example. A person skilled in the art would understand there may be many alternatives, variations and modifications. For example, (A) of FIG. 3 shows a same structure but a different implementation of the winding structure in the PCB.

As shown in FIG. 6, the distance between a middle point of the first straight line 612 and the outer edge of the first non-straight line 614 is defined as D. The distance between the middle point of the first straight line 612 and the inner edge of the first non-straight line 614 is defined as d. The distance between the first straight line 612 and the second straight line 622 is defined as x. The parameters D and d can be adjusted to obtain a desirable inductance with a good inductance to resistance ratio. The gap x can be used to adjust the location sensitivity when a receiver is placed on a transmitter.

In some embodiments, a current may flow through the winding structure 600 shown in FIG. 6. In particular, the current flows from the first non-straight line 614 to the first straight line 612, from the first straight line 612 to the connection element 606, from the connection element 606 to the second non-straight line 624 and from the second non-straight line 624 to the second straight line 622. After the current flows through the first portion 602 which is an almost enclosed area, the current forms a first magnetic field in the first portion 602. Likewise, after the current flows through the second portion 604 which is an almost enclosed area, the current forms a second magnetic field in the second portion 604. Since the current flows in a clockwise direction in the first portion 602 and flows in a counter-clockwise direction in the second portion 604, the first magnetic field and the second magnetic field are in opposite directions.

One advantageous feature of having the magnetic field configuration shown in FIG. 6 is that, to a point outside a space adjacent to the winding structure 600, the first magnetic field and the second magnetic field may cancel out each other, thereby reducing the magnetic interference from the winding structure 600.

It should be noted that while FIG. 6 shows each portion of the winding structure 600 has a single turn, the magnetic interference reduction mechanism may be applicable to a winding structure having multiple turns. For example, referring back to FIG. 3(B), the first portion of the winding structure is a first coil wound in a clockwise direction having a plurality of turns. Each turn of the first portion has an almost enclosed shape. The second portion of the winding structure is a second coil wound in a counter-clockwise direction having a plurality of turns. Each turn of the second portion has an almost enclosed shape. Furthermore, the first portion and the second portion are substantially symmetrical with respect to a center line between the first portion and the second portion. When a current flows through the first portion and the second portion of the winding structure shown in (B) of FIG. 3, the magnetic field formed in the first portion and the magnetic field formed in the second portion are in opposite directions. As a result, to a point outside the winding structure shown in (B) of FIG. 3, the magnetic field generated in the first portion and the magnetic field generated in the second portion may cancel out each other. While FIG. 6 shows the winding structure comprises two almost enclosed portions, it is within the spirit of this invention for the winding structure to comprise more than two portions. Furthermore, the portions of the winding structure may have different shapes and may be not symmetrical. In addition, a magnetic material may be added to the winding structure to form a magnetic shield when needed.

Figure 7:
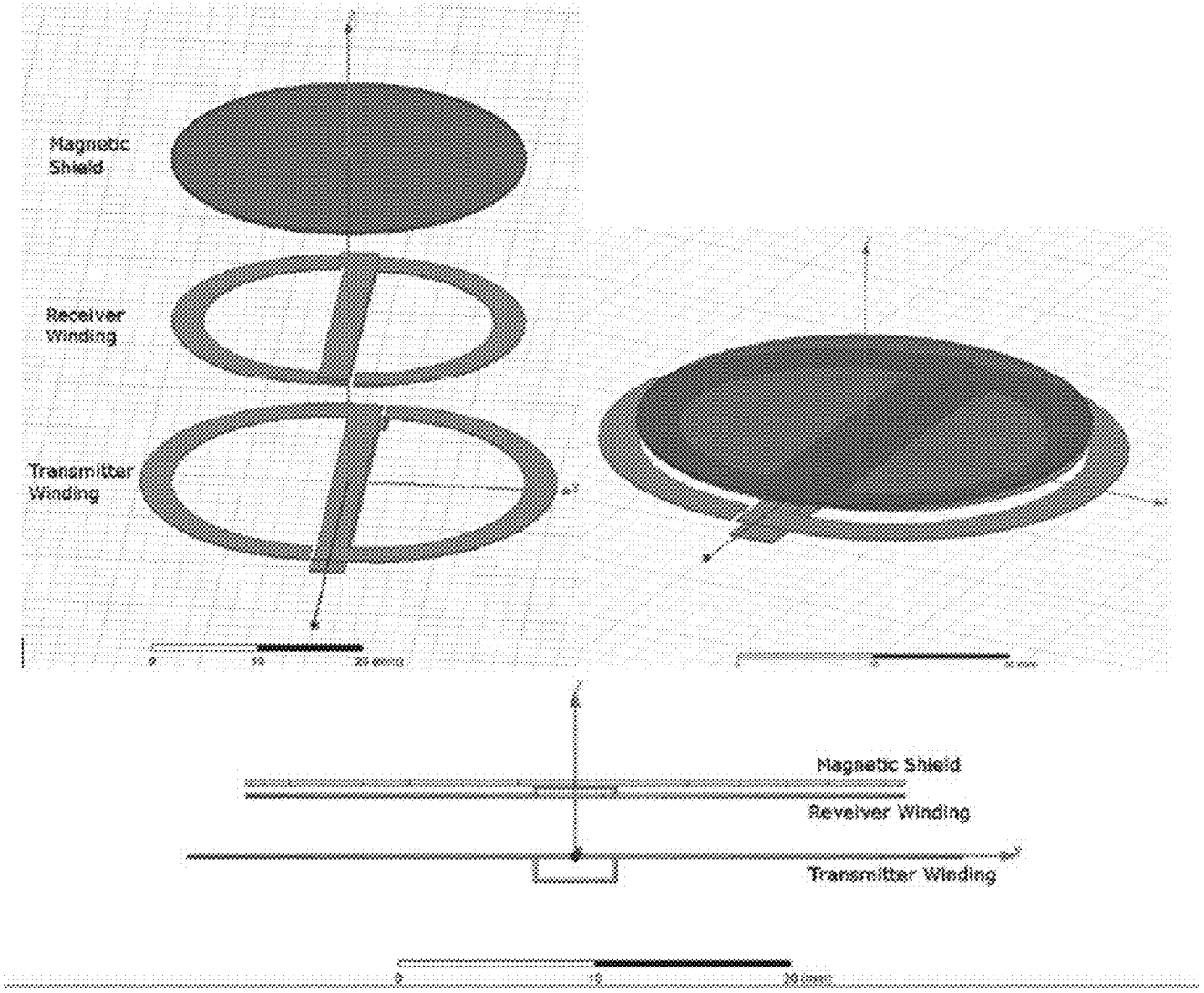
FIG. 7 illustrates a first implementation of the winding structures shown in FIG. 6 in accordance with various embodiments of the present disclosure.

FIG. 7 illustrates a first implementation of the winding structures shown in FIG. 6 in accordance with various embodiments of the present disclosure. FIG. 7 is an example setup of a transmitter coil, a receiver coil and a magnetic shield which can be mechanically attached to the receiver coil and/or the transmitter coil. The upper portion of FIG. 7 shows a perspective view of a system including a magnetic shield, a receiver winding (a.k.a. coil) and a transmitter winding. The lower portion of FIG. 7 shows a cross sectional view of the system.

In some embodiments, both the transmitter coil and the receiver coil shown in FIG. 7 have the structure shown in FIG. 6. In some embodiments, the transmitter coil is magnetically coupled to the receiver coil. Power is wirelessly transferred between the transmitter coil and the receiver coil. Because the flux density is high around the center of the winding structure, significant power transfer capability can be maintained even if the receiver coil is not aligned very well with the transmitter coil. Such a feature helps to improve the spatial freedom of the wireless power transfer. In addition, the distance X shown in FIG. 6 can be used to adjust the spatial freedom of the wireless power transfer.

Figure 8:
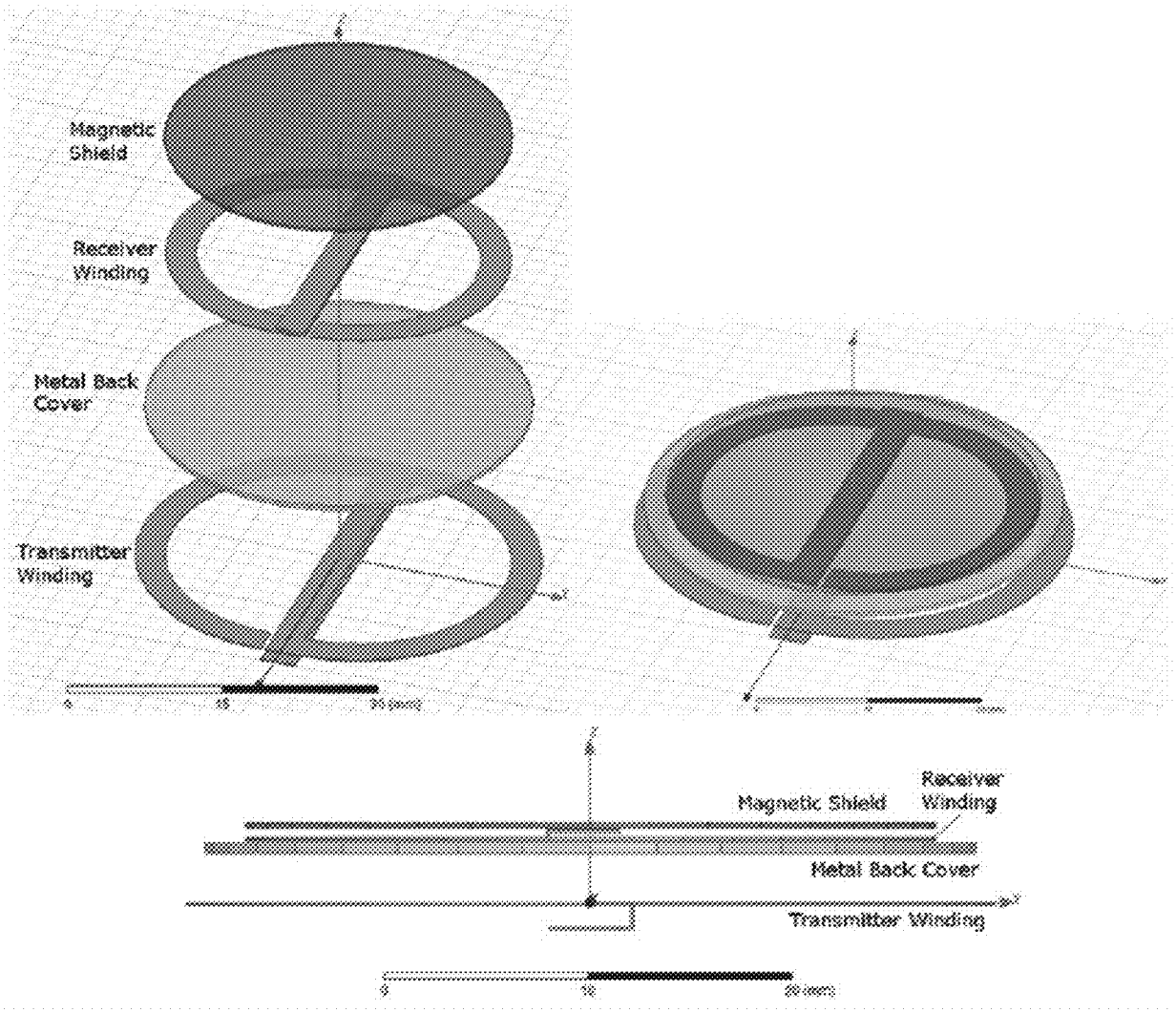
FIG. 8 illustrates a second implementation of the winding structures shown in FIG. 6 in accordance with various embodiments of the present disclosure.

FIG. 8 illustrates a second implementation of the winding structures shown in FIG. 6 in accordance with various embodiments of the present disclosure. FIG. 8 is a setup similar to FIG. 6 except that a metal back cover has been inserted between the receiver coil and the transmitter coil. In some embodiments, the metal back cover can be mechanically attached to the receiver coil or the transmitter coil. Alternatively, the metal back cover can be a separate component. Throughout the description, the metal back cover may be alternatively referred to as a metal cover or a metal plate.

It should be noted the shape of the metal cover is merely an example. A person skilled in the art would recognize many modifications, alternatives and variations. For example, the metal cover may be rectangular in shape. Furthermore, it is within the scope and spirit of the invention for the metal cover to comprise other shapes, such as, but not limited to oval, square and the like.

Figure 9:
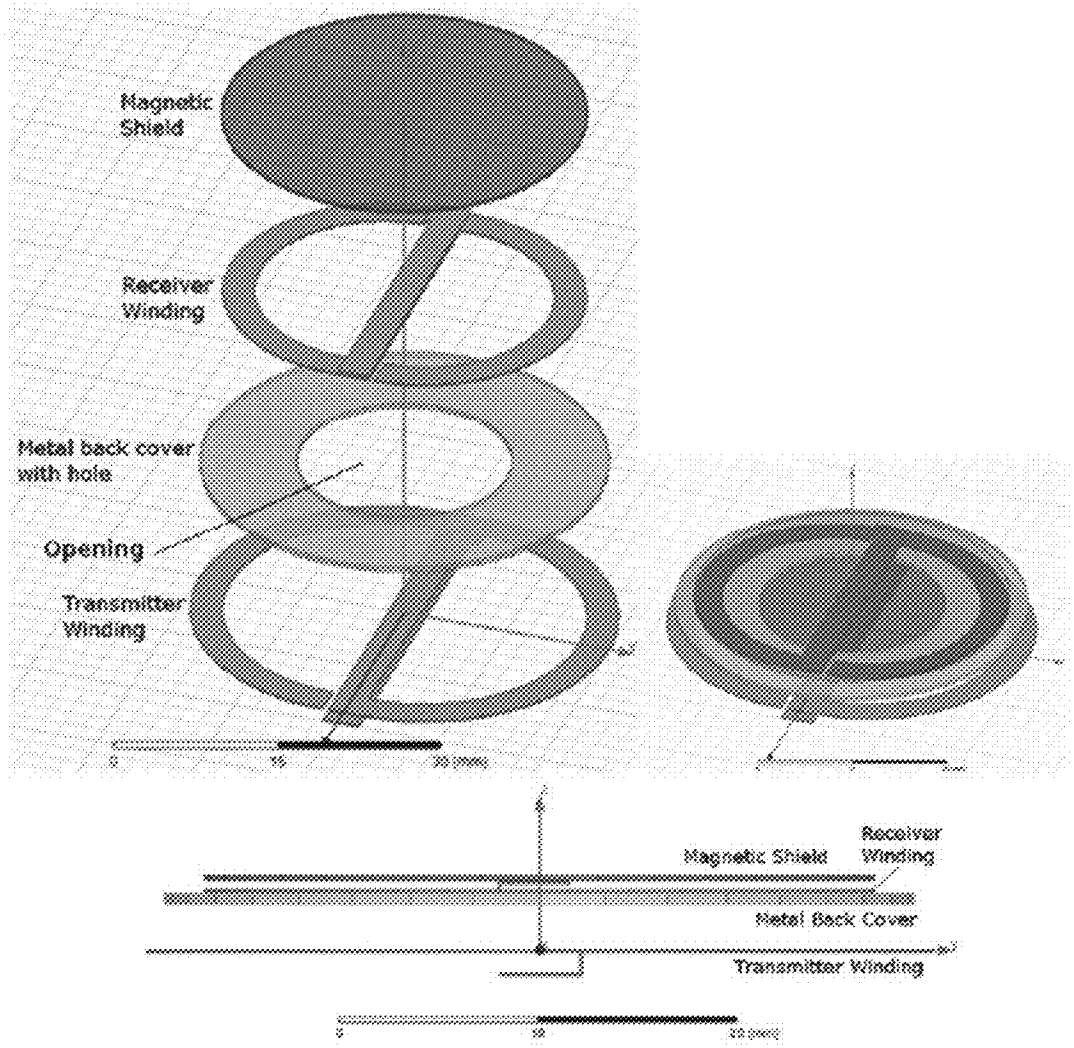
FIG. 9 illustrates a third implementation of the winding structures shown in FIG. 6 in accordance with various embodiments of the present disclosure.

FIG. 9 illustrates a third implementation of the winding structures shown in FIG. 6 in accordance with various embodiments of the present disclosure. FIG. 9 is a setup similar to FIG. 8 except that the metal cover has an opening. As shown in FIG. 9, the opening is circular in shape and in the center region of the metal cover. In some embodiments, the size and shape of the opening shown in FIG. 9 is employed to improve the magnetic coupling between the transmitter coil and the receiver coil.

As shown in FIG. 9, the opening may be substantially circular in shape. It is within the scope and spirit of the invention for the opening to comprise other shapes, such as, but not limited to oval, rectangular and the like.

It should be noted that an area of the opening is substantially smaller in size than an area of the receiver coil and/or an area of the transmitter coil. In some embodiments, the area of the opening is equal to or less than 70% of the area of the receiver coil/transmitter coil.

Figure 10:
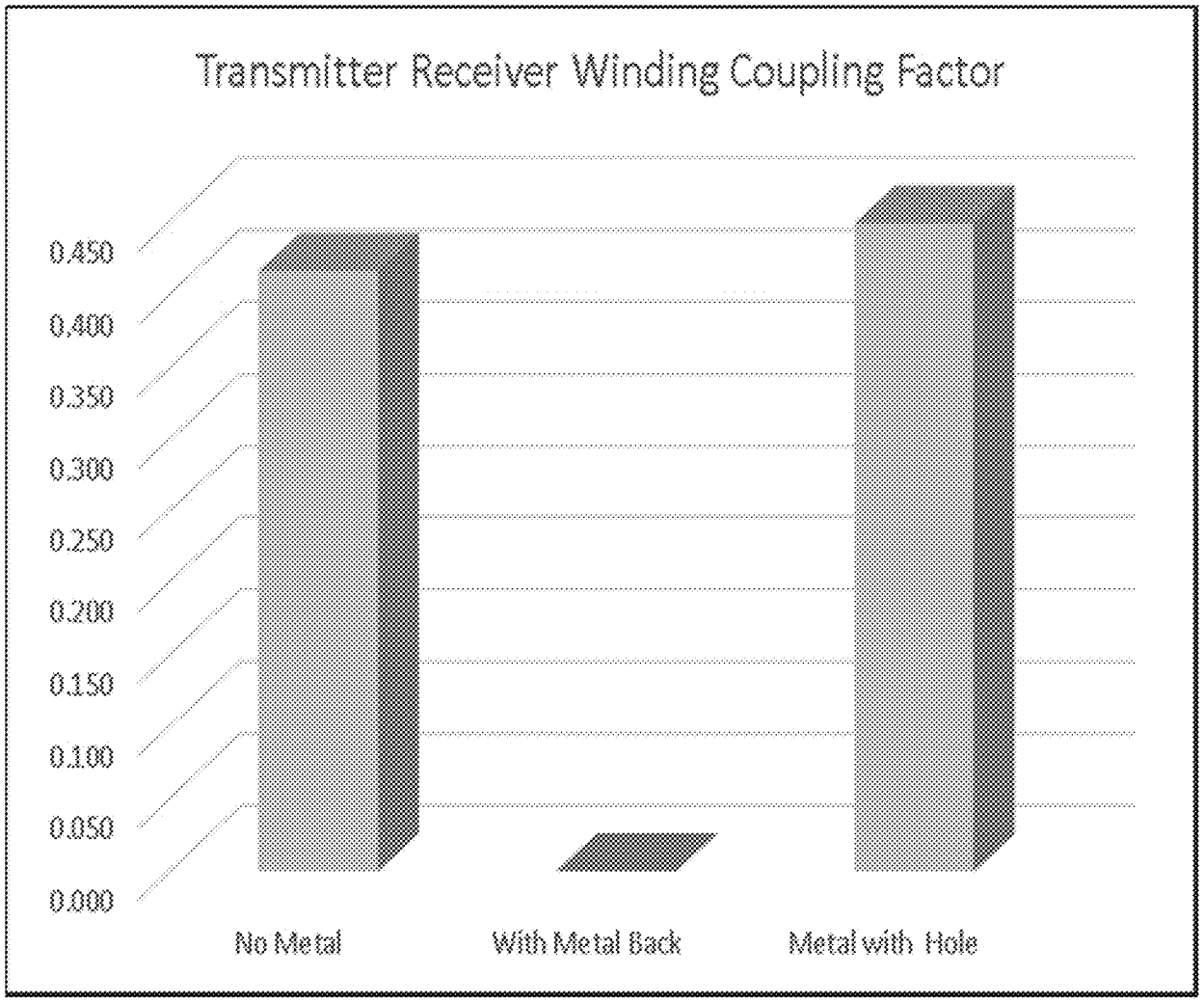
FIG. 10 illustrates simulation results of the coupling coefficients of various implementations of the transmitter and receiver coils in accordance with various embodiments of the present disclosure.

FIG. 10 illustrates simulation results of the coupling coefficients of various implementations of the transmitter and receiver coils in accordance with various embodiments of the present disclosure. FIG. 10 shows the simulated magnetic coupling coefficient (factor) between a transmitter coil and a receiver coil. Without a metal cover (corresponding to the setup shown in FIG. 7), the coupling coefficient is approximately equal to 0.39, which is reasonable for a wireless power transfer system.

With a solid metal cover (corresponding to the setup shown in FIG. 8), the coupling becomes weak. As shown in FIG. 10, the coupling coefficient of the setup in FIG. 8 is less than 0.05. As a result, the wireless power transfer between the transmitter coil and the receiver coil under such a weak coupling coefficient becomes very difficult. However, when a suitable opening is formed in the metal cover (corresponding to the setup shown in FIG. 9), the magnetic coupling between the transmitter coil and the receiver coil is now higher than in the case without having a metal cover. As shown in FIG. 10, the coupling coefficient of the setup in FIG. 9 is in a range from about 0.42 to about 0.43. In other words, the opening in the metal cover can improve the wireless power transfer between a transmitter coil and a receiver coil.

Figure 11:
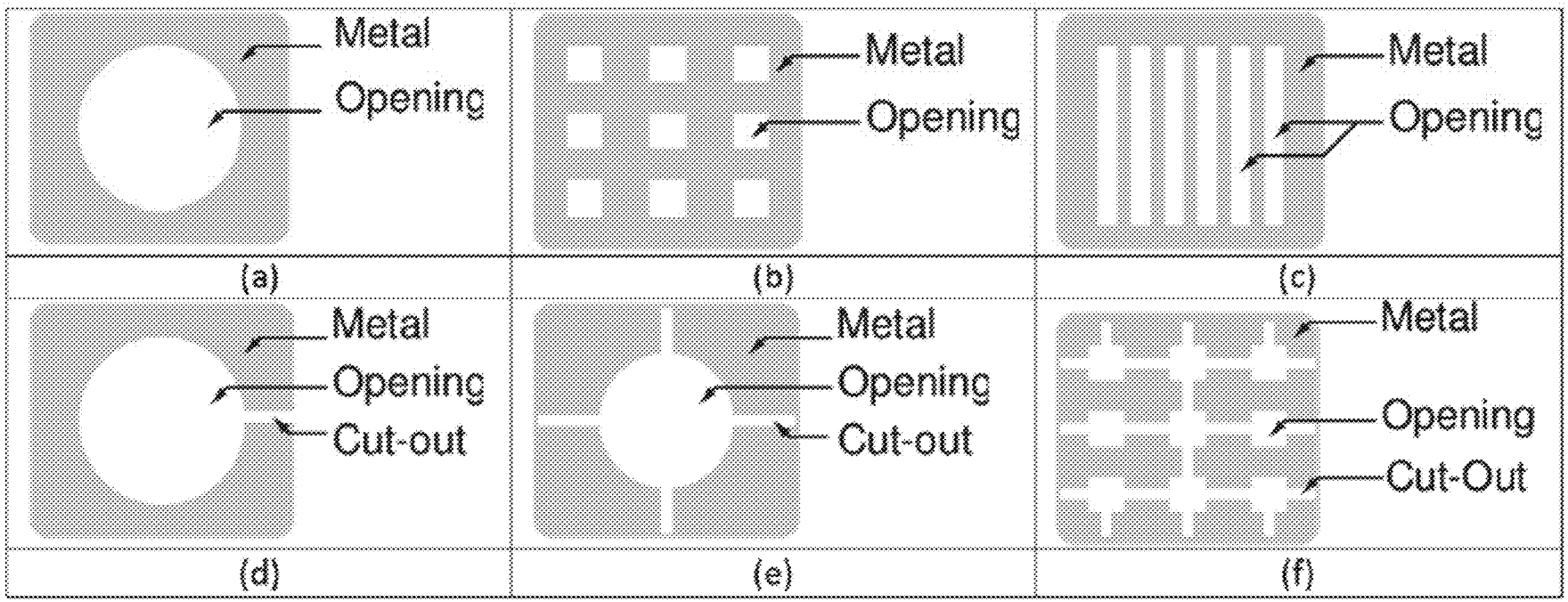
FIG. 11 illustrates a variety of implementations of the metal cover shown in FIG. 9 in accordance with various embodiments of the present disclosure.

FIG. 11 illustrates a variety of implementations of the metal cover shown in FIG. 9 in accordance with various embodiments of the present disclosure. In some embodiments, the metal cover may comprise a single opening as shown in (a) of FIG. 11. In alternative embodiments, the metal cover may comprise a plurality of openings. The plurality of openings may be arranged in rows and columns as shown in (b) of FIG. 11. Alternatively, the plurality of openings may be placed in parallel as shown in (c) of FIG. 11. As discussed above, the shape and the size of the opening may be used to enhance the magnetic coupling between a transmitter coil and a receiver coil, and/or enhance other aspects of a wireless power transfer system.

In some embodiments, a significant induced eddy current may flow in the metal cover and cause unnecessary power losses. In order to reduce the induced eddy current, small cutouts may be formed in the metal cover as shown in (d) of FIG. 11, (e) of FIG. 11 and (f) of FIG. 11. Throughout the description, the small cutouts may be alternatively referred to as trenches.

(d) of FIG. 11 shows a trench is formed in the metal cover. The trench is connected to the opening. (e) of FIG. 11 shows four trenches are formed in the metal cover. The four trenches are connected to the opening and placed in a symmetrical manner with respect to the opening. (f) of FIG. 11 shows a plurality of openings and trenches are formed in the metal cover. The plurality of openings are arranged in cows and columns. The trenches are connected to their respective openings as shown in (f) of FIG. 11.

The shape, location, size and/or number of openings can all be used to further improve the performance of a wireless power system with a metal cover in the transmitter or the receiver. In addition, the cutouts can be placed at various locations of the metal cover to further reduce the eddy current around such locations, regardless of whether a big opening is located nearby.

Figure 12:
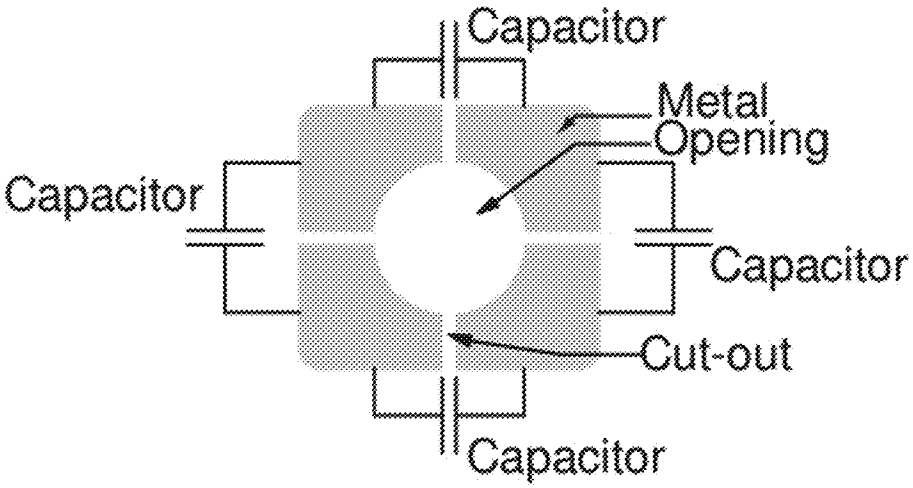
FIG. 12 illustrates a structure for utilizing the eddy current around an opening of the metal cover in accordance with various embodiments of the present disclosure.

FIG. 12 illustrates a structure for utilizing the eddy current around an opening of the metal cover in accordance with various embodiments of the present disclosure. Another way to utilize the eddy current around an opening is to use a capacitor to shape the impedance of an eddy current loop. FIG. 12 shows multiple capacitors are connected across the cutouts around a big opening. It should be recognized that while FIG. 12 illustrates the opening coupled with four capacitors, the opening could be coupled with any number of capacitors. Furthermore, the capacitors can be coupled with more than one opening depending on different design needs and applications. In some embodiments, a capacitor may comprise a dielectric material placed inside or around a cutout. Furthermore, the capacitor may be formed by sidewalls of the cutout and a dielectric material filled between the sidewalls of the cutout.

The capacitors shown in FIG. 12 can control the amplitude and the phase of the eddy current in the loop relative to the magnitude and the phase of the magnetic field in the opening. In this way, it is possible to shape the eddy current so that it generates a magnetic field which enhances the original magnetic field in the opening in magnitude, and thus increases the magnetic coupling between the transmitter coil and the receiver coil.

In the case described above, the eddy loop or loops become an intermediate coil between the transmitter coil and the receiver coil. Such an intermediate coil is able to enhance the coupling and improve the system performance of wireless power transferring. Especially, if the inductance of an eddy current loop (Lr) and the capacitance (Cr) of the capacitor or capacitors in the eddy current loop have a resonant frequency approximately equal to the wireless power transfer frequency: $f \approx 1/(2\pi\sqrt{LrCr})$, where f is the frequency of wireless power transfer (e.g., the frequency of the main flux of the transmitter). Lr is the inductance of the eddy current loop, Cr is the capacitance in the eddy current loop which includes the equivalent capacitance of the added capacitor (capacitors) shown in FIG. 12.

It should be noted that it is not necessary to have the resonant frequency to be the same as the wireless power transfer frequency for this technique to be effective. It should further be noted that if multiple openings and thus multiple eddy current loops are located in a metal cover, not all loops need to have a capacitor connected with the loop as shown in FIG. 12 despite that it is acceptable to connect the capacitor with all loops. In addition, different winding structures, including the traditional winding structures shown in FIG. 1, may also be used depending on different applications and design needs.

A non-conductive material may be fully or partially filled in all or some of the openings and cut-outs. The filling materials may be a magnetic material (such as a ferrite compound with permeability higher than 1), or a non-magnetic material. As long as the filling material's electrical resistance is high (much higher than that of Copper or Aluminum), the electrical-magnetic performance will not be compromised. Furthermore, all or part of the openings and the cut-outs may form certain patterns, text(s), shapes or even logos when necessary.

In the above discussion, methods of constructing air core magnetic components with self-closed or almost self-closed magnetic fields are shown. It can be integrated into system printed circuit boards without having interference with surrounding components, thereby achieving tight control, stable inductance and less conduction losses. The structures and methods described above with respect to FIGS. 3-12 could also be used in high frequency dc/dc power converters to enable low profile, high power density power conversions. For example, the structures shown in FIGS. 3 and 6 could be used to construct the output filter inductor for a high frequency step-down dc/dc converter.

Although embodiments of the present invention and its advantages have been described in detail, it should be understood that various changes, substitutions and alterations can be made herein without departing from the spirit and scope of the invention as defined by the appended claims.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A system comprising:

a transmitter coil having a first winding structure comprising a first portion starting from a first terminal of the first winding structure, the first portion having a first almost enclosed shape wound in a clockwise direction, the first portion including a first straight line and a first curved line, and a second portion ending at a second terminal of the first winding structure, the second portion having a second almost enclosed shape wound in an anti-clockwise direction, the second portion including a second straight line and a second curved line, wherein the first terminal and the second terminal of the winding are immediately adjacent to each other, and wherein the first straight line is over the second straight line, and edges of the first straight line are vertically aligned with edges of the second straight line, and wherein the first curved line and the second curved line form an almost enclosed circle, and wherein a length of the first straight line is substantially equal to a diameter of the almost enclosed circle;

a receiver coil having a similar winding structure as the transmitter coil, wherein the receiver coil is configured to be magnetically coupled to the transmitter coil; and a metal plate with an opening placed between the transmitter coil and the receiver coil.

2. The system of claim 1, further comprising:

a trench coupled to the opening; and a capacitor coupled to the trench, wherein the capacitor is configured such that a resonant frequency formed by an inductance from an induced eddy current flowing in the metal plate and a capacitance of the capacitor is approximately equal to a frequency of a current flowing in the transmitter coil.

3. The system of claim 2, wherein:

the capacitor is formed by sidewalls of the trench and a dielectric material filled between the sidewalls of the trench.

4. The system of claim 1, wherein:

the first curved line and the second curved line are on opposite sides of a center line between the first straight line and the second straight line.

5. The system of claim 1, further comprising:

a magnetic shield attached to one of the transmitter coil and the receiver coil.

6. The system of claim 1, wherein:

an area of the opening is substantially smaller in size than an area of the receiver coil or an area of the transmitter coil.

7. A method comprising:

wirelessly transferring power from a transmitter coil to a receiver coil, wherein at least one of the transmitter coil and the receiver coil comprises:

a first portion having a first almost enclosed shape wound in a clockwise direction, wherein the first almost enclosed shape includes a first straight line and a first curved line;

a second portion having a second almost enclosed shape wound in a counter-clockwise direction, wherein the second almost enclosed shape includes a second straight line and a second curved line; and a connection portion between the first portion and the second portion, wherein the first portion and the second portion are arranged in a substantially symmetrical manner, and wherein a starting point of the first portion, an ending point of the second portion and the connection portion are immediately adjacent to each other, wherein edges of the first straight line are vertically aligned with edges of the second straight line;

placing a metal plate between the transmitter coil and the receiver coil, wherein the metal plate comprises an opening;

forming a trench connected to the opening;

filling a dielectric material in the trench to form a capacitor; and selecting the dielectric material of the capacitor such that an inductance from an eddy current flowing through the metal plate and a capacitance of the capacitor form a resonant frequency approximately equal to a frequency of a current flowing in the transmitter coil.

8. The method of claim 7, further comprising:

forming a plurality of openings and a plurality of trenches in the metal plate, wherein:

the plurality of openings are arranged in rows and columns; and the plurality of trenches are connected to the plurality of openings, wherein at least one trench of the plurality of trenches passes through two adjacent openings.

* * * * *